United States Patent [19]

Rhee

[11] 3,945,045

[45] Mar. 23, 1976

[54] PROTECTIVE GLOVE FOR THE HAND

[76] Inventor: Jhoon Goo Rhee, 2525 N. Ridgeview Road, Arlington, Va. 22207

[22] Filed: Sept. 8, 1975

[21] Appl. No.: 611,424

Related U.S. Application Data

[63] Continuation-in-part of Ser. No. 468,681, May 10, 1974, Pat. No. 3,903,546.

[52] U.S. Cl. ..... 2/16; 2/18

[51] Int. Cl.[2] ..... A41D 13/10

[58] Field of Search ..... 2/16, 18, 2, 19, 20, 161 R, 2/161 A, 159, 162

[56] References Cited

UNITED STATES PATENTS

| | | | |
|---|---|---|---|
| 3,258,782 | 7/1966 | Turnidge et al. | 2/161 R |
| 3,626,515 | 12/1971 | Murray | 2/16 |
| 3,903,546 | 9/1975 | Rhee | 2/16 |

*Primary Examiner*—G. V. Larkin

*Attorney, Agent, or Firm*—Millen, Raptes & White

[57] ABSTRACT

A unitary flexible protective glove molded of a resilient material and adapted to be easily worn on the hand for use in the art of karate and the like. The basic embodiment of the glove, when worn, covers mainly the back and sides of the hand, the thumb and wrist and is provided with a thickened forward portion. The glove is secured to the hand by an encircling portion around the wrist, a loop portion across the palm of the hand, a forward finger securing portion and thumb portion each comprising strap securing means for the thumb and one or several fingers.

Several variations of the basic embodiment provide for modified means for retaining the glove on the hand and also include an encircling portion extending beyond the wrist to a portion of the arm.

6 Claims, 20 Drawing Figures

PROTECTIVE GLOVE FOR THE HAND

This application is a continuation-in-part of my copending patent application Ser. No. 468,681 filed May 10, 1974 now U.S. Pat. No. 3,903,546.

BACKGROUND OF THE INVENTION

This invention relates to a protective glove adapted to be worn on the hand in the art of karate, kung fu, etc. The art of karate, in particular, is a method developed in Japan for defending oneself without the use of weapons by striking sensitive areas of an attacker's body with the hands, elbows, knees, or feet. During training in the art and in organized competition, the use of the hands can become badly bruised from extensive use of the fingers, palm, back and sides of the hands, as well as the wrist. The present invention provides various embodiments and modifications of a novel glove adapted to protect and prevent injury to the various parts of the hand and wrist as well as preventing injury to the sensitive areas of the body of other persons engaging in the art during training or competition.

SUMMARY OF THE INVENTION

It is an object of this invention to provide a novel protective glove for use in karate sports and the like, which is designed to protect various parts of the hand and wrist of the wearer and which can be easily slipped on or off the wearer's hand.

Another object of this invention is to provide a novel protective glove of simplified construction, relatively inexpensive and which will obviate injuries to the hand of the wearer and to the body of other persons while engaging in the art of karate, etc.

Another object of this invention is to provide a novel protective glove which permits the hand of the wearer to be used with the fingers extended or the hand can be used as a fist to deliver various types of blows in the art of karate, etc.

A further object of the invention is to provide various embodiments and modifications of a glove comprising novel means for retaining the glove on the hand.

Generally, the basic embodiment of the protective glove comprises a resilient material having a tough, outer coating preferably a plastic coating, which is adapted to generally cover particularly the back and side of the hand, back of the thumb, and most of the wrist of the wearer. The glove is designed to allow flexibility as well as protection in the use of the fingers and thumb to permit the optimum use of the hand as a weapons in arts and sports, such as karate, to effectively deliver various types of chops and blows as well as fending off opposing chops and blows. The glove is detachably secured to the hand by various securing means, such as strap means, adapted to be easily engaged by the fingers and thumb of the wearer of the glove.

Other features and advantages of the invention will become apparent from the following description of a specific embodiment of the protective glove taken in connection with the drawings.

Figure 1:
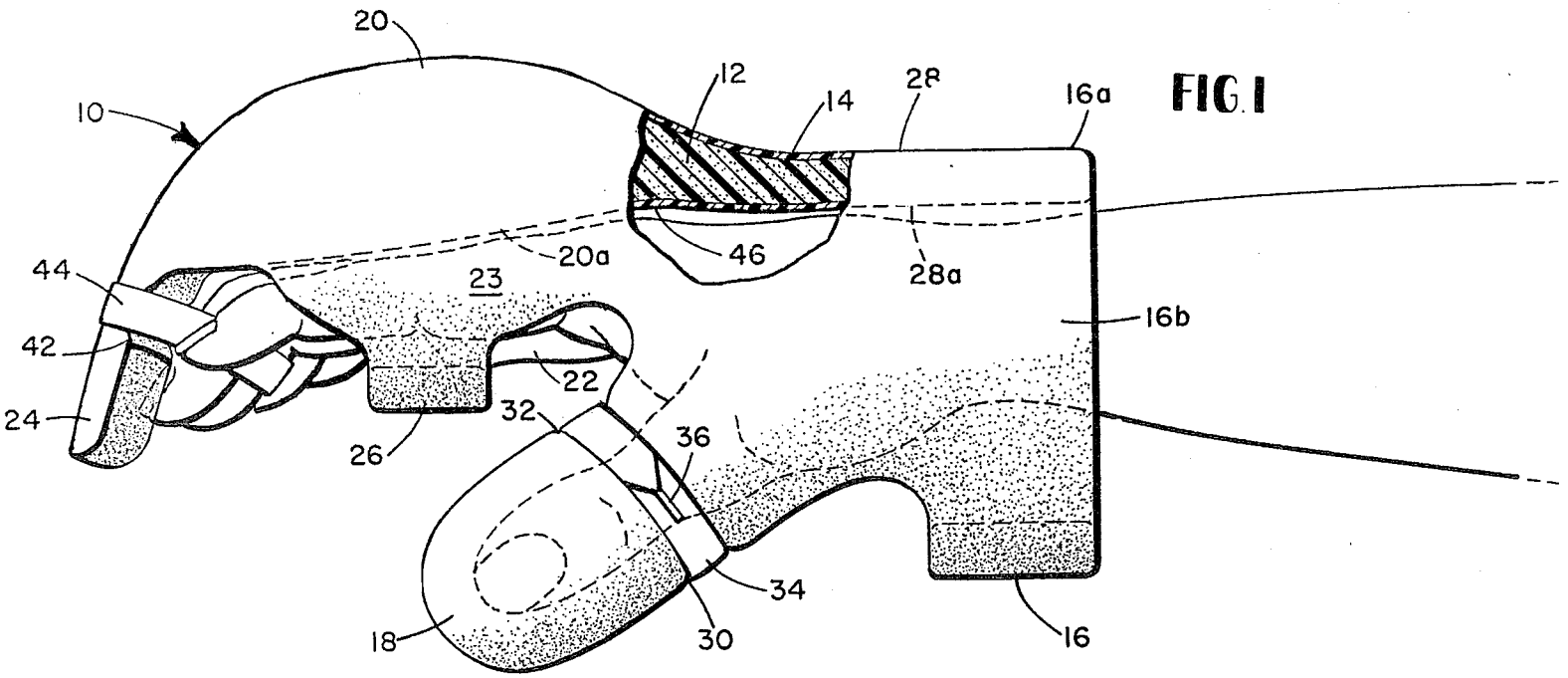
FIG. 1 is a side elevational view of one embodiment of the novel protective glove of the invention showing it as worn on the hand of a wearer.
Figure 6:
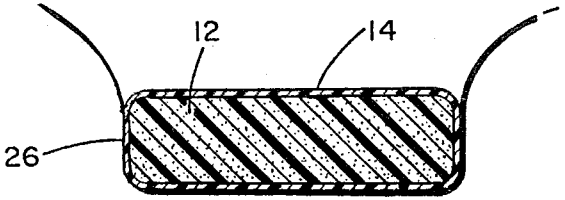
FIG. 6 is a sectional view taken along line 6—6 of FIG. 3.
Figure 2:
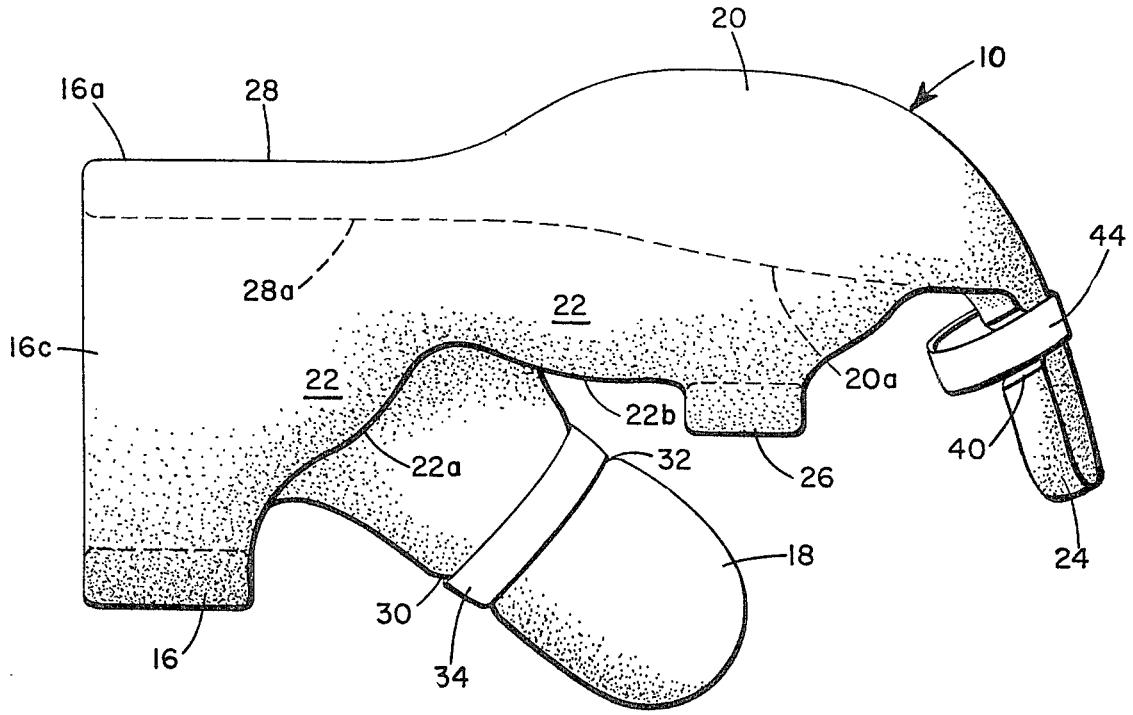
FIG. 2 is the opposite side elevational view of the protective glove shown in FIG. 1.
Figure 3:
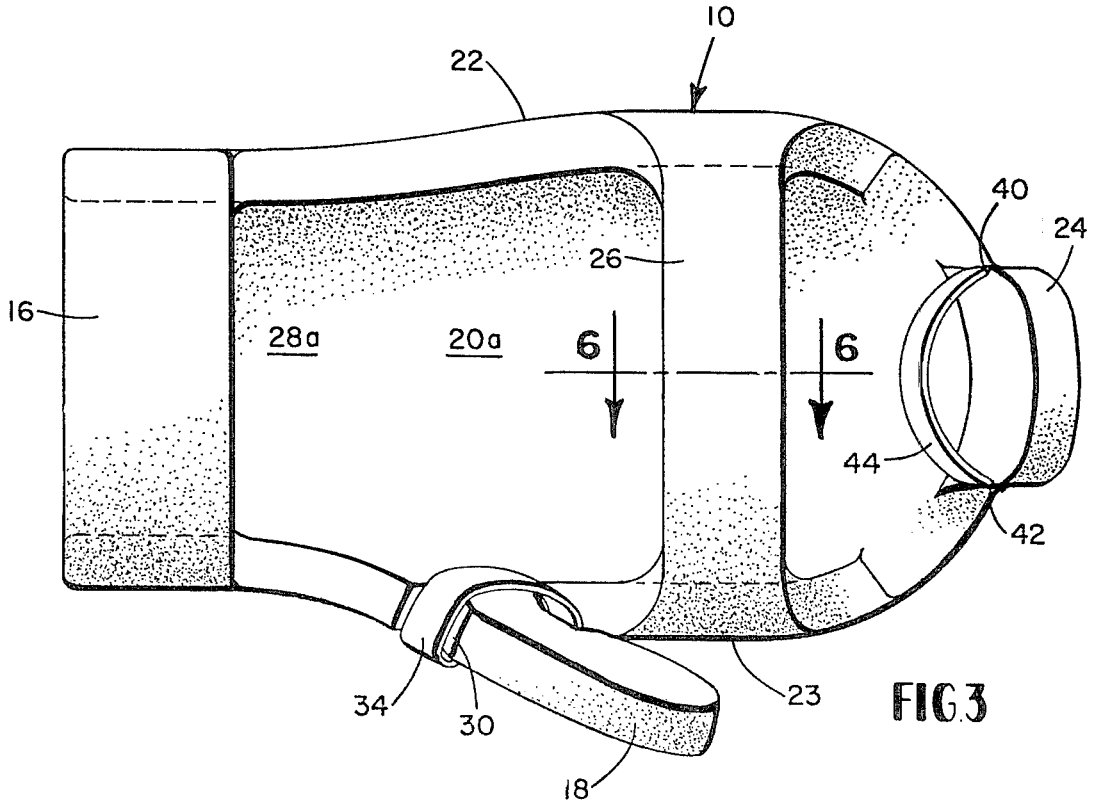
FIG. 3 is a bottom plan view of the protective glove shown in FIG. 1.
Figure 4:
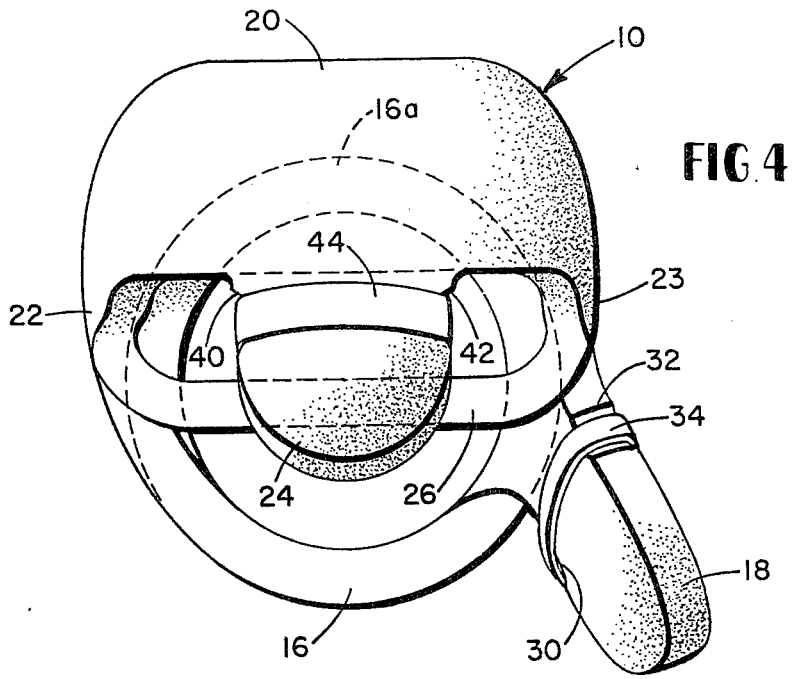
FIG. 4 is a front end view of the protective glove shown in FIG. 1.

The first embodiment of the protective glove of this invention shown in FIGS. 1–7 is indicated generally by the numeral 10 in FIG. 1 and comprises a unitary molded member formed from a suitable resilient material 12 capable of absorbing energy, such as a plastic, polystyrene, polyurethane, or polyvinylchloride foam, or a rubber foam and the like. A suitable tough surface coating or casing 14, preferably smooth, covers the entire resilient material, whcih can be a tough, tear-resistant pliable material, preferably a suitable plastic material or the like. The coating 14 can be formed during heating and molding of the resilient foam material to produce a fused coating thereon. Alternatively, the surface coating 14 can be formed on the resilient material by spraying, dipping or applying and securing a coating of a suitable plastic material or the like. Plastic coatings are preferred since there are available on the market, many rugged tough pliable plastic materials such as polyvinylchloride, etc. However, it is also contemplated within the concept of the invention that suitable rugged fabric materials, and the like, can be used to cover the resilient material. The coating or covering used should provide a continuous, flexible, tough casing which prevents tearing of the foam material during use of the glove.

Glove 10 comprises a wrist portion 16 encircling the wrist, a thumb portion 18, a thickened portion 20, side hand portions 22 and 23, a finger securing portion 24, and a loop portion 26 adapted to secure the glove across the palm of the hand of the wearer.

The loop wrist portion 16 entirely encircles the wrist of the wearer and extends at the upper part 16*a* to a section 28 which covers the back part of the hand and to the thickened portion 20. The thumb side portion 16*b* of wrist portion 16 extends across the side of the hand to portion 23 and thumb portion 18. The side 16*c* of the wrist portion 16 extends across the opposite side of the hand to section 22.

Loop portion 26 is disposed beneath the underside 20*a* of the portion 20 and connects to sides 22 and 23, providing an opening and securing means through which the fingers of the wearer are inserted. When the hand is fully inserted in the glove, the loop portion passes across the palm of the hand.

Thumb portion 18 is flexible and comprises an extended generally thumb-shaped member adapted to be secured to the thumb of the wearer by any suitable means, such as a strap 34, secured around the thumb portion 18. Strap 34, as shown, can comprise any suitable tightening means such indentations tongue and groove 36. Thumb portion 18 also comprises indications 30 and 32 around which strap 34 passes and is retained thereon when the strap is tightened around the thumb, preferably to a pre-tightened position permitting the thumb to be easily inserted or withdrawn whenever the glove is worn or taken off.

The finger securing portion 24 extends downwardly from the mid-portion at the end of thickened section 20, and is adapted to receive and be retained by one or preferably two of the middle fingers of the wearer. Portion 24 comprises indentations 40 and 42 around which a suitable securing means such as strap 44 passes, and is retained thereon when the strap 44 is tightened around the finger or fingers similar to strap 34.

Figure 5:
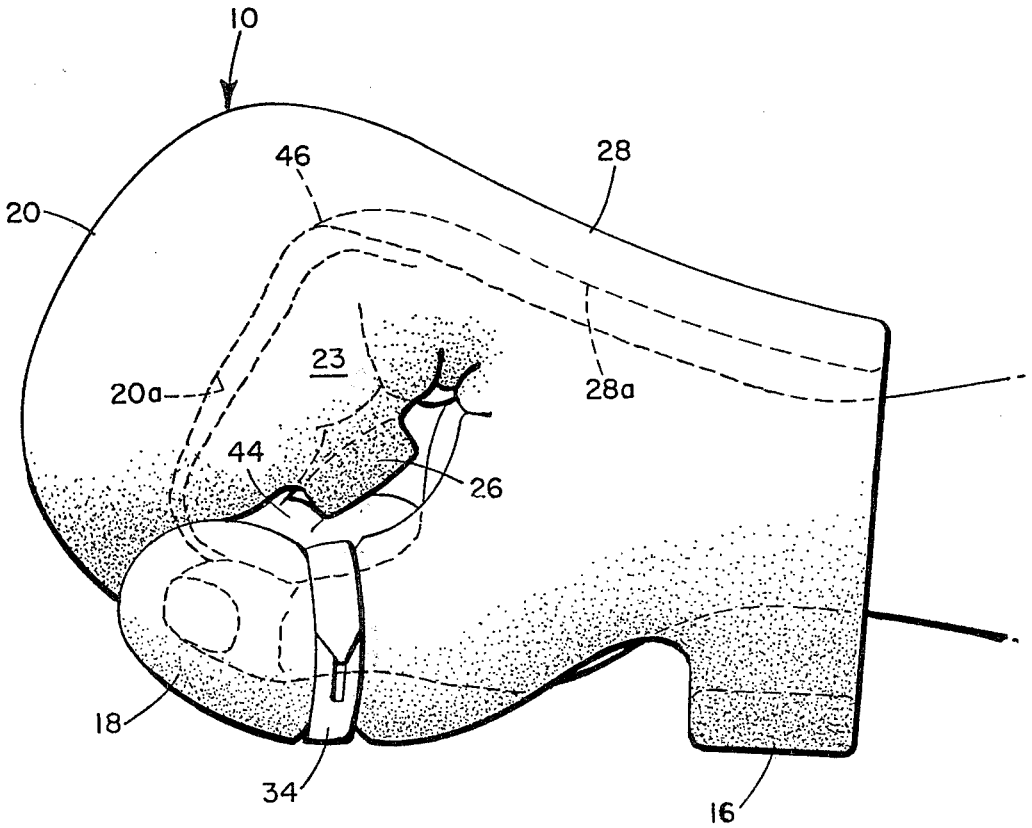
FIG. 5 is a side elevational view of the protective glove shown in FIG. 1, showing the glove on the hand of a wearer with the hand formed into a fist.
Figure 7:
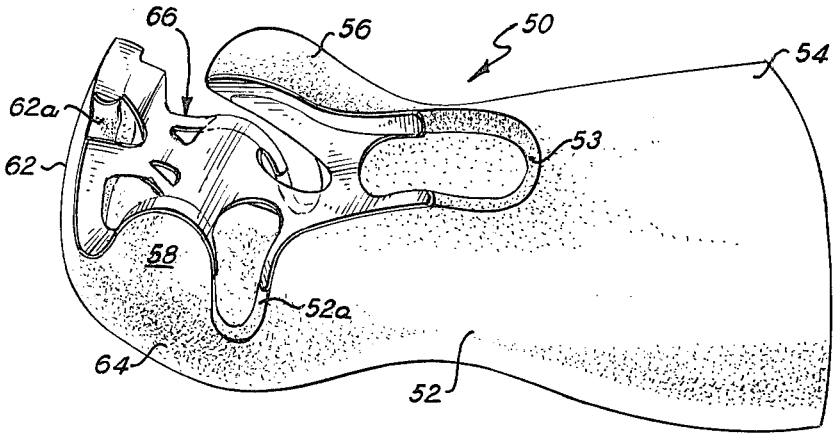
FIG. 7 is a generally side perspective view of a second embodiment of the novel protective glove of the invention.
Figure 8:
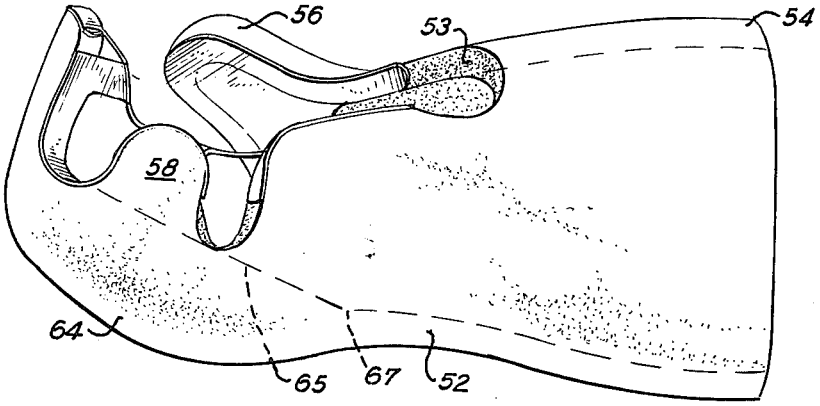
FIG. 8 is a side elevational view of the protective glove shown in FIG. 7.
Figure 9:
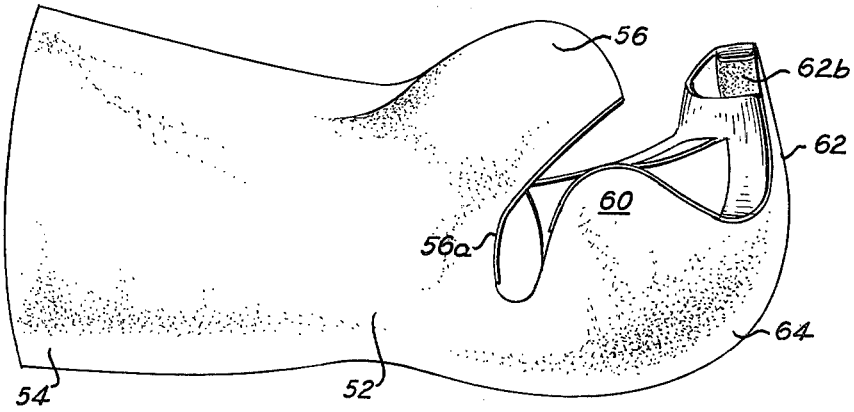
FIG. 9 is an elevational view of the side opposite to that shown in FIG. 8.
Figure 10:
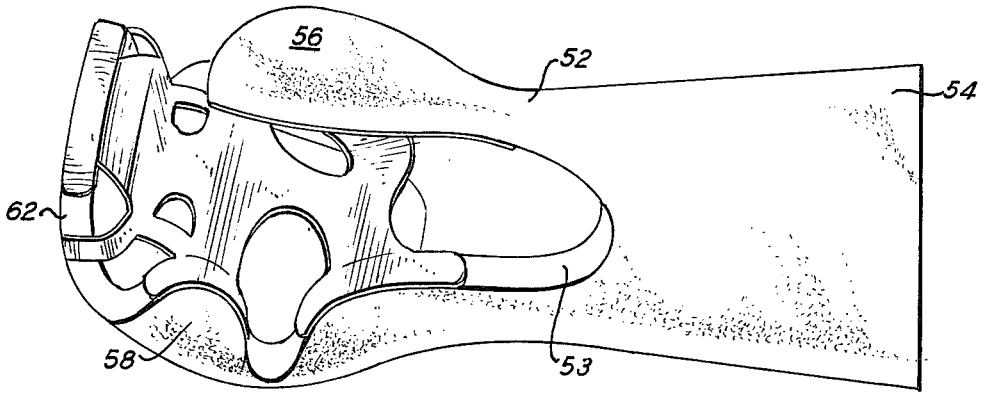
FIG. 10 is a generally top perspective view of the protective glove shown in FIG. 7.
Figure 12:
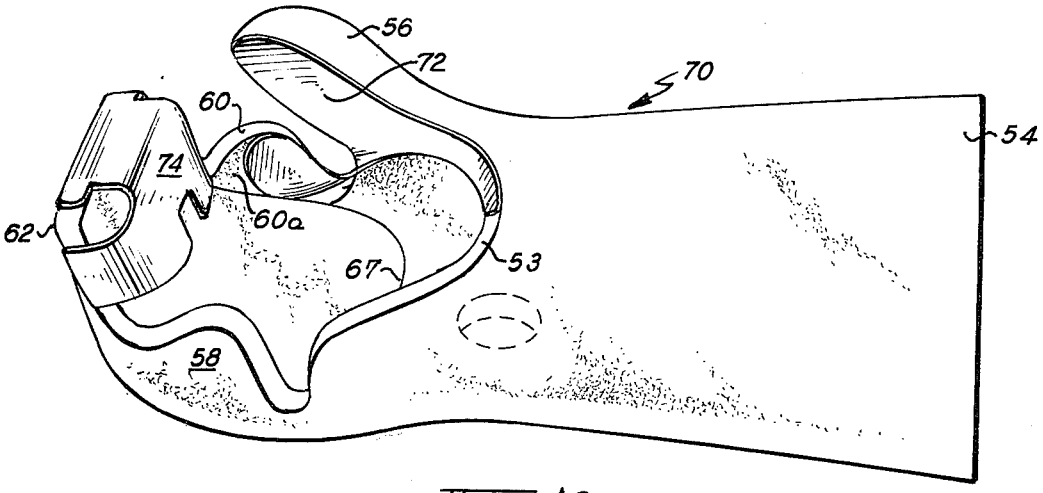
FIG. 12 is a generally side perspective view of a modification of the protective glove shown in FIG. 7.
Figure 13:
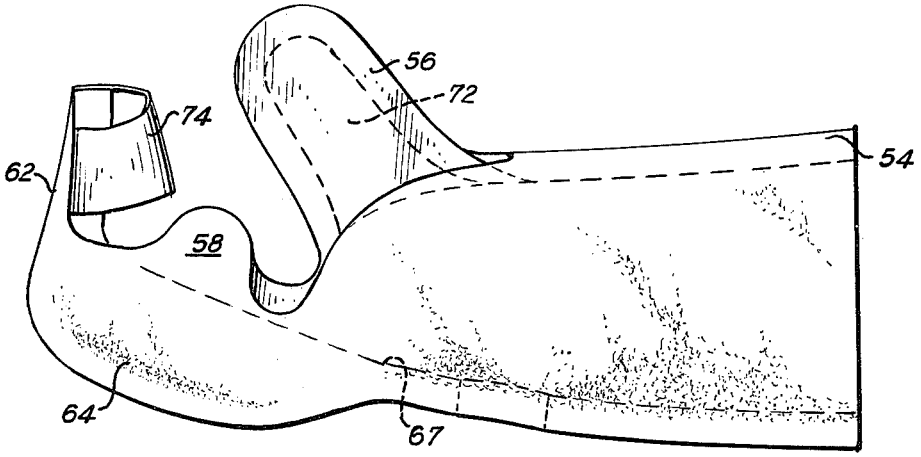
FIG. 13 is a side elevational view of the protective glove shown in FIG. 12.
Figure 14:
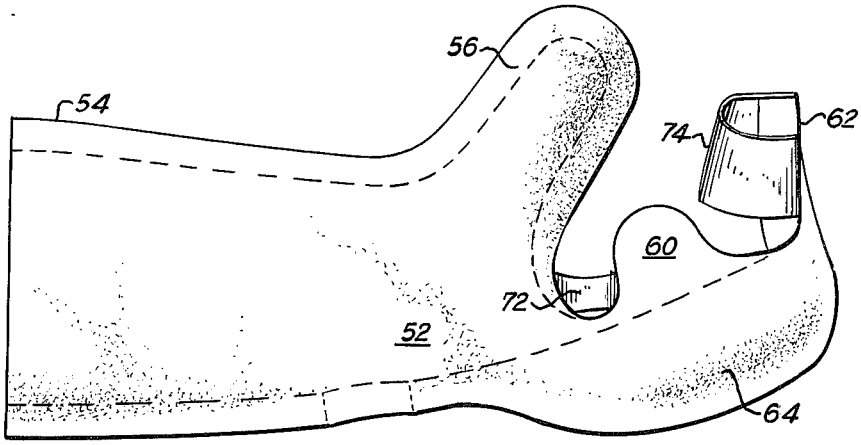
FIG. 14 is an elevational view of the side opposite to that shown in FIG. 13.
Figure 15:
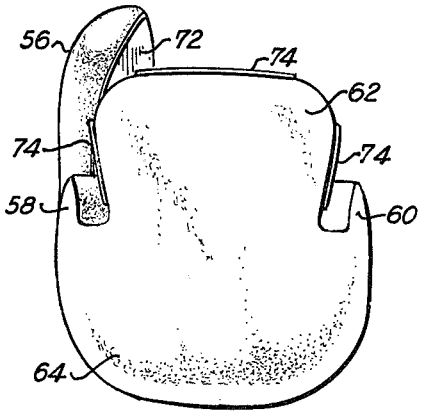
FIG. 15 is a front end view of the protective glove shown in FIG. 12.

The thickened portion 20 is adapted to provide additional protection to the backs of the fingers in delivering various types of blows in the karate art. Portion 20 is adapted to fold inwardly at the juncture 46 wherein the thickened portion 20 extends from section 28. The underside 20*a* of portion 20 is an extension of the underside 28*a* of section 28, and both are adapted to generally conform to the back of the hand. Juncture 46 is generally designed to conform across the knuckles of the hand. Thus, when the hand is formed into a fist as shown in FIG. 5, the thickened portion 20 will fold with the fingers providing the additional protection therefor in delivering a blow.

Side portion 22 is adapted to provide additional protection to the side of the hand opposite the thumb side. It is designed in such a manner that when a fist is formed, the sections 22*a* and 22*b* will generally fit together to provide the protection to the side of the hand. However, when the glove is worn and the hand is in an extended position as shown in FIG. 1, and the side portions 22 also covers and provides protection to the side of the hand when delivering various karate chops or in fending off an opponent's blows, etc.

Side hand portion 23 on the thumb side is similarly adapted to provide protection to the side of the hand not covered by the thumb portion 18. It is designed similarly as portion 22 in that when a fist is formed, the section 23*a* and 23*b* will generally fit together to provide protection to the side of the hand. However, as is the case with portion 22, when the hand is in the extended position it also covers and protects the thumb side of the hand and permitting the delivery of various karate chops.

In use, glove 10, is easily worn on the hand by merely inserting the hand and fingers through wrist portion 16, passing the fingers under loop 26, securing one or two of the middle fingers to strap 44 of portion 24, and inserting the thumb under strap 34 of portion 18. As worn on the hand, the glove permits the fingers to be extended and held together to permit the delivery of various types of karate chops with either side of the hand while at the same time providing protection thereto. The unique construction of the glove also permits the hand to be closed or clenched as a fist permitting the wearer to strike a blow with the fist, while particularly protecting the fingers and thumb. The glove is uniquely adapted to be flexible in its various uses and permits desirable quick adaption to various hand forms such as a fist or extended finger positions as required in the fast moving art of karate.

Referring now to FIGS. 7-10, a second embodiment shown generally by the numeral 50, of the protective glove of the invention is shown. Its materials of construction are the same as those shown and described for the embodiment 10 of the protective glove.

Glove 50 comprises a wrist portion 52, an arm portion 54, a thumb portion 56, side hand portions 58 and 60, a finger portion 62, a thickened portion 64, and a retaining means shown generally by the numeral 66.

The arm portion 54 entirely encircles a portion of the arm of the wearer and extends to wrist portion 52 which covers and encircles the back of the wrist of the wearer and is open in the area of 53 to permit flexing of the wrist. Portions 52 and 54 cover and protect the entire lower arm and most of the wrist of the wearer, while at the same time permitting a degree of flexibility and use of the arm and wrist.

The wrist portion 52 extends to thumb portion 56 which extends therefrom and is adapted to protect the thumb. The thumb portion is flexible and comprises an extended generally thumb-shaped member adapted to be secured to the thumb of the wearer as will be seen hereinafter.

A thickened portion 64 is adapted to provide additional protection to the backs of the fingers and is adapted to fold inwardly at juncture 67 where the thickened portion 64 extends from wrist portion 52. The juncture 67 is generally designed to conform across the knuckles of the hand. Thus, the hand can be formed into a fist and the thickened portion will fold with the fingers as with embodiment 10.

The front portion of the glove comprises a flexible finger portion 62 extending at an angle inwardly from the thickened portion 64. The angle of the finger portion is about 90° with respect to an inner flat portion 65 of the thickened portion 64.

At both sides of the glove, protective portions 58 and 60 are provided to protect the sides of the hand. The side portions are designed such that when a fist is formed, portion 58 will meet the side 62*a* of finger portion 62 and side 52*a* of the wrist portion 52. Similarly, portion 60 will meet the side 62*b* of finger portion 62 and side 56*a* of the thumb portion. However, as is the case with embodiment 10, when the hand is in the extended position, portions 58 and 60 cover and protect the sides of the hand when delivering karate chops and the like.

Figure 11:
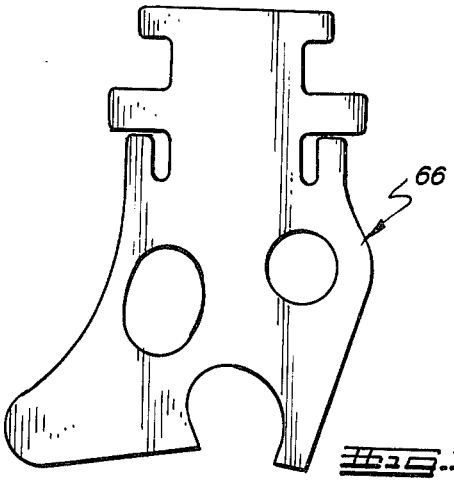
FIG. 11 is a pattern of the securing means for the fingers, palm and thumb of the protective glove shown in FIG. 7.

The retaining means 66 is shown as a pattern in FIG. 11. The pattern is adapted to be secured by suitable means, such as an adhesive, to the rims of the finger portion 62, side portions 58 and 60, thumb portion 56 and wrist portion 52. The retaining means is a tough tear-resistant generally smooth, pliable material made preferably of a plastic material such as polyvinylchloride. The retaining means when secured to the glove forms a pocket for the fingers in the finger portion 62, a pocket for the thumb in portion 56, and a pocket across side portions 58 and 60 which is adapted to pass across the palm of the hand of the wearer. The retaining means is designed in its configuration to provide maximum retaining capabilities for the glove on the hand, while providing minimum interference with the flexibility of the use of the fingers, thumb and hand of the wearer.

In FIGS. 12–17, a modification is shown of the protective glove embodiment 50 of FIGS. 7–11. The modification, generally denoted by the numeral 70, is the same with respect to the materials of construction as those shown for the embodiments 10 and 50 of the protective glove.

Glove 70 has the same basic construction as glove 50 comprising wrist portion 52, arm portions 54, thumb portion 56, side hand portions 58 and 60, finger portion 62, and thickened portion 64. Area 53 is not as open back along the arm portion as in glove 50. The showing is to illustrate that the inner wrist portion can be varied in its openness to provide lesser or greater flexibility in using the glove and for protection of the inner wrist.

Figure 16:
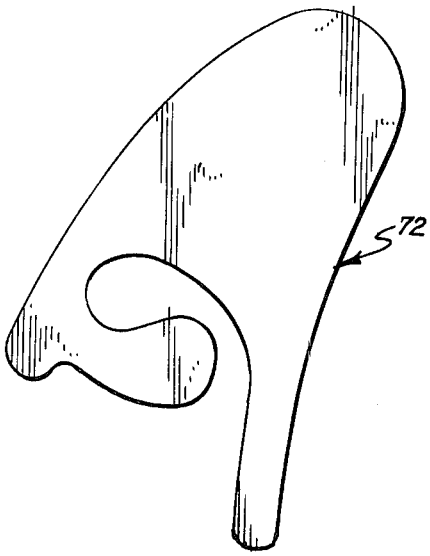
FIG. 16 is a pattern of the securing means for the thumb portion of the protective glove shown in FIG. 12.
Figure 17:
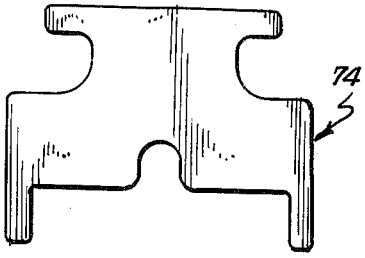
FIG. 17 is a pattern of the securing means for the fingers portion of the protective glove shown in FIG. 12.

In glove 70, a modification is disclosed for the retaining means. Separate retaining means are provided for the finger portion 62 and the thumb portion 56. The retaining means are shown in FIGS. 16 and 17 as patterns. Retaining means 72 are adapted to be secured by suitable means, such as an adhesive, to the rims of the thumb portion, to the inner part 60*a* of portion 60, and to a part of the rim of area 53 of the wrist portion. Retaining means 72 forms a pocket with thumb portion 56 wherein the thumb of the wearer can be inserted and retained. Similarly, retaining means 74 is adapted to be secured to the top and side rims of finger portion 62 to form a pocket therewith, wherein the fingers of the wearer can be inserted and retained.

Both gloves 50 and 70 are easily worn and retained by merely inserting the hand and fingers through arm portion 54 and passing the fingers and thumb into the retaining means provided.

Figure 18:
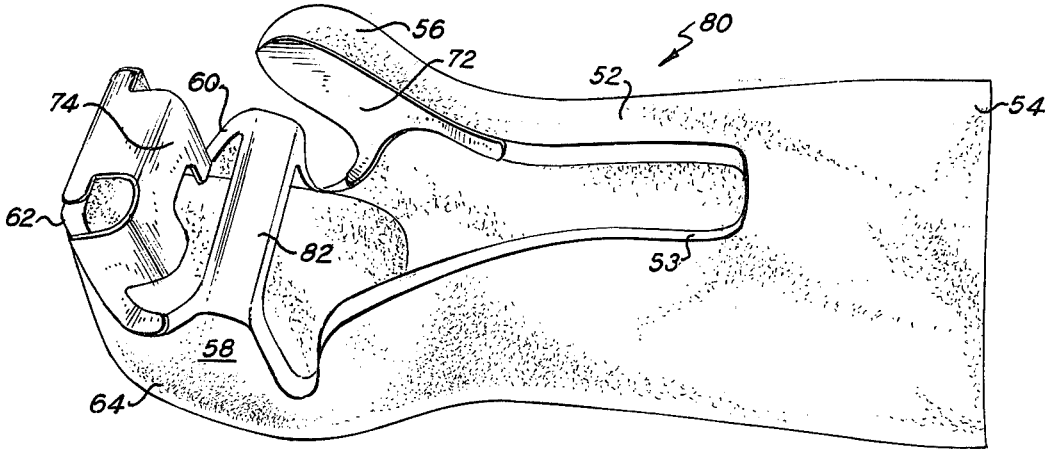
FIG. 18 is a generally side perspective view of a modification of the novel protective glove shown in FIG. 12.
Figure 19:
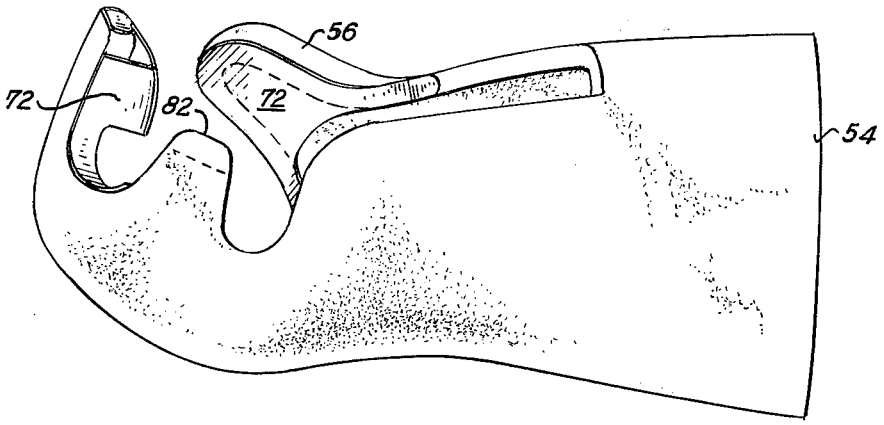
FIG. 19 is a side elevational view of the protective glove shown in FIG. 18.
Figure 20:
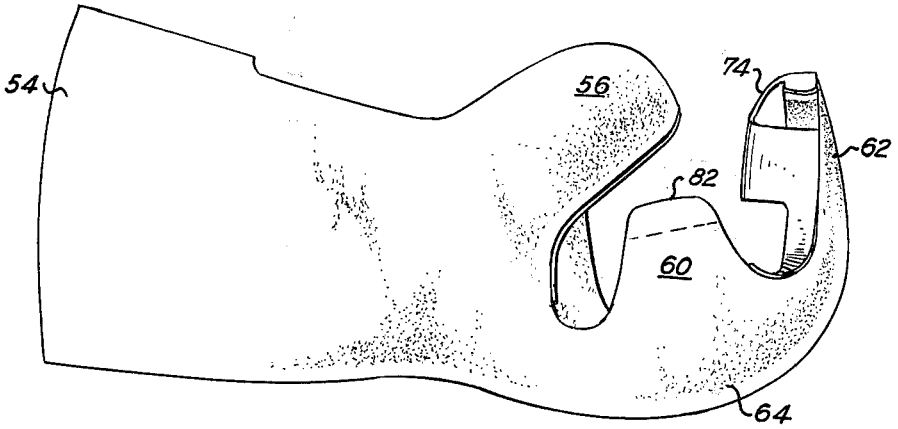
FIG. 20 is an elevational view of the side opposite to that shown in FIG. 19.

In FIGS. 18–20, a modification, shown generally by the numeral 80, of the protective glove 70 of the invention is shown. Its materials of construction are the same as those shown and described for the embodiment 10 of the protective glove.

Glove 80 has generally the same construction as glove 70 comprising wrist portions 52, arm portion 54, thumb portion 56, side hand portions 58 and 60, finger portion 62 and thickened portion 64. Area 53 is shown as extending back into the arm portion 54 and illustrates again that this area can be varied in its openness to provide the desired flexibility in using the glove with various degrees of protection in the wrist and arm portions.

In glove 80, in addition, a loop portion 82 is provided and molded as part of the glove construction. It is molded integrally with the tops of the side hand portions 58 and 60, and is designed to extend across the palm area of the hand of the wearer. Loop portion 82 provides additional retaining means to aid in retaining the protective glove on the hand of the wearer.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A flexible, unitarily molded, protective glove for wearing and use in the art of karate and the like, and adapted to cover the back and sides of the hand including the fingers and thumb and also adapted to cover the wrist and a portion of the arm, comprising a rear portion having an arm portion, a wrist portion, two side portions, a thumb portion, a front portion having a thickened portion, a finger portion, and retaining and securing means; said arm portion extending to a point below the elbow of the wearer and comprising generally cylindrical encircling means adapted to surround the arm; said wrist portion comprising encircling means adapted to partially surround the wrist and open at the inner wrist; said side portions extending upwardly from the respective sides of said front portion adapted to cover the sides of the hand; said thumb portion extending from the side of said wrist portion and adapted to cover the back of the thumb; said finger portion extending upwardly from the forward part of said front portion adapted to cover the backs of the fingers; said retaining means extending across the inner portion of said glove adapted to retain the glove on the wearer's hand; said securing means disposed across each of said thumb and finger means adapted to secure the glove to the thumb and fingers of the wearer; said entire glove comprising resilient foam means covered with a tough surface casing; whereby said front portion and rear portions of the glove when worn on the hand are normally disposed in a finger extended position and whereby said front and rear portions are also capable of being folded together to form a fist.

2. The protective glove of claim 1 wherein said front portion and thickened portion are adapted to fold at a juncture with the rear portion of the glove to form a fist.

3. The protective glove of claim 1 wherein said retaining means and said securing means are a single pattern formed from a flexible, pliable material adapted to be secured to the rims of said finger, thumb, wrist and side portions.

4. The protective glove of claim 1 wherein individual securing means are disposed across said finger portion and said thumb portion forming pockets, and no retaining means are included.

5. The protective glove of claim 1 wherein individual securing means are disposed across said finger portion and said thumb portion forming pockets, and said retaining means comprises a looped portion extending between said side portions and integral therewith.

6. The protective glove of claim 5 wherein said inner wrist portion has an open section which extends into said arm portion.

* * * * *